US008226187B2

(12) United States Patent
Snyder et al.

(10) Patent No.: US 8,226,187 B2
(45) Date of Patent: Jul. 24, 2012

(54) TILT MITIGATION METHODS TO CONTROL RESERVOIR INK LEVEL AND PRINTHEAD PRESSURE

(75) Inventors: Trevor James Snyder, Newberg, OR (US); David L. Knierim, Wilsonville, OR (US); David Paul Platt, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 328 days.

(21) Appl. No.: 12/752,075

(22) Filed: Mar. 31, 2010

(65) Prior Publication Data

US 2011/0242157 A1 Oct. 6, 2011

(51) Int. Cl.

| | |
|---|---|
| ***B41J 2/195*** | (2006.01) |
| *B41J 2/155* | (2006.01) |
| *B41J 2/175* | (2006.01) |
| *B41J 2/19* | (2006.01) |
| *B41J 2/17* | (2006.01) |

(52) U.S. Cl. ..... 347/7; 347/42; 347/85; 347/92; 347/94

(58) Field of Classification Search ..... 347/7, 42, 347/85, 92, 94

See application file for complete search history.

(56) References Cited

U.S. PATENT DOCUMENTS

| | | | | |
|---|---|---|---|---|
| 4,620,202 | A * | 10/1986 | Koto et al. | 347/87 |
| 4,806,955 | A * | 2/1989 | Koto et al. | 347/30 |
| 5,070,347 | A * | 12/1991 | Yuki et al. | 347/86 |
| 6,957,882 | B2 * | 10/2005 | Wouters et al. | 347/86 |
| 6,994,425 | B2 | 2/2006 | Silverbrook | |
| 7,083,246 | B2 | 8/2006 | Yeh et al. | |

FOREIGN PATENT DOCUMENTS

JP 05338192 A * 12/1993

* cited by examiner

*Primary Examiner* — Laura Martin
*Assistant Examiner* — Jeremy Bishop
(74) *Attorney, Agent, or Firm* — Maginot, Moore & Beck, LLP

(57) ABSTRACT

An ink level control system includes a first dividing wall that divides a reservoir of a printhead into a first chamber and a second chamber. The first and the second chambers are each connected to the ink passages of the inkjet stack by an ink port. The first dividing wall includes an opening that connects the first chamber and the second chamber to enable ink to pass therebetween. The opening is located a predetermined distance above the bottom surface of the reservoir. An ink diverter is associated with the inlet opening that directs ink received through the inlet opening to one of the first and the second chambers in response to the reservoir being tilted in a first direction, and directs ink to the other of the first and the second chambers in response to the reservoir being tilted in a second direction.

19 Claims, 6 Drawing Sheets

TILT MITIGATION METHODS TO CONTROL RESERVOIR INK LEVEL AND PRINTHEAD PRESSURE

TECHNICAL FIELD

This disclosure relates generally to printheads of an inkjet imaging device, and, in particular, to systems and methods for controlling ink level in the reservoir of such printheads.

BACKGROUND

In general, inkjet printers include at least one printhead having a plurality of inkjets for ejecting drops of ink toward an ink receiving surface. In some printheads, the plurality of inkjets is implemented by a stack of laminated sheets or plates, commonly referred to as an inkjet stack. As an example, printhead 22 shown in FIG. 3 includes an inkjet stack 40 having an aperture plate 46 that includes apertures 44 through which drops of ink are ejected by the inkjets. The inkjet stack also includes ink passages or channels 42 that deliver ink to the inkjets. The ink passages 42 of the inkjet stack supply channels receive ink from an on-board reservoir 50 of the printhead via one or more ink supply ports 52.

The ink receiving surface may comprise recording media, such as paper, or an intermediate imaging member, such as a rotating drum or belt. During operation, the ink receiving surface is moved past the printheads in a direction referred to herein as the process direction. The inkjets of the printheads are arrayed in a direction perpendicular to the process direction, also referred to herein as the cross-process direction. In some previously known printers, the individual printheads used in the printer are narrower than the width of the ink receiving surface in the cross-process direction. To enable full width printing in these printers, multiple printheads are arranged across the width of the ink receiving surface. Each printhead, however, requires a separate electrical and ink supply connection. Using multiple printheads to enable full width printing may therefore increase the cost and/or complexity of the printer.

As an alternative to using multiple printheads to enable full width printing, a single printhead that is wide enough to extend across the width of the ink receiving surface may be used. An example of a full width printhead is depicted in FIG. 4. In order to supply ink to all of the inkjets of the inkjet stack 40 in a timely manner, the inkjet stack is connected to the reservoir 50 using multiple ports 52. For example, in FIG. 4, two supply ports 52 are used to connect the on-board reservoir 50 to the supply channels (not shown in FIG. 4) of the inkjet stack 40 with one supply port 50 being located near each lateral end 56, 58 of the reservoir. A single full width printhead requires fewer electrical and ink supply connections than multiple printheads combined into an array. Therefore, using wider printheads may decrease the cost and/or the complexity of a printer.

Wider printheads, however, are more sensitive to the effects of tilting than narrower printheads. For example, when a reservoir is not tilted, as depicted in FIG. 4, the distance between the bottom surface 60 of the reservoir 50 and the top surface 54 of the ink in the reservoir 50 is the same across the width of the reservoir. When the reservoir is tilted as depicted in FIG. 5, one end 58 of the reservoir dips lower than the other end 56. Consequently, as ink volume shifts toward the lower end of the reservoir, the distance $H_2$ between the bottom surface of the reservoir and the ink level in the lower end 58 of the reservoir is increased (i.e., $H_2>H$), and the distance $H_1$ between the bottom surface 60 of the reservoir and the ink level in the higher end 56 of the reservoir is decreased (i.e., $H_1<H$).

Depending on the magnitude of tilt, the decreased ink height $H_1$, where $H_1$ is less than H, in the higher end 56 of the tilted reservoir may cause the ink port 52 in that end 56 of the reservoir to be located partially or fully above the top surface 54 of the ink, as depicted in FIG. 5. Consequently, the ink port 52 may not be able to adequately supply ink to that end of the inkjet stack. In addition, as is known in the art, changes in ink height in the reservoir may cause a corresponding change in the pressure head on the ink at the apertures 44 in the aperture plate 46. The changes in ink height caused by tilt may therefore result in unexpected pressure variations in the printhead that may result in inconsistent drop formation by the inkjets of the inkjet stack.

SUMMARY

In order to prevent or reduce the effects of tilting on ink levels and pressures in a printhead, an on-board reservoir of a printhead may be provided with an ink level control system that divides the reservoir into a plurality of chambers. The ink level control system is configured to control the ink level in each chamber separately in order to maintain a top surface of ink in each chamber within a predetermined distance from the bottom surface of the reservoir.

In accordance with one particular embodiment, a printhead includes an inkjet stack having ink passages that define a plurality of inkjets and an aperture plate that defines a plurality of apertures through which drops of ink are ejected by the inkjets. The printhead also includes a reservoir having a bottom surface and a plurality of walls configured to contain a quantity of ink. The reservoir has an inlet opening through which ink is received in the reservoir. An ink level control system is provided in the reservoir that includes at least a first wall that extends from the bottom surface of the reservoir and divides the reservoir into at least a first chamber and a second chamber. Each of the first and the second chambers is connected to the ink passages of the inkjet stack by an ink port. The wall includes an opening that enables ink to pass between the first chamber and the second chamber. The opening is located a predetermined distance above the bottom surface of the reservoir so that ink is prevented from escaping the first and the second chamber when an ink level in the first and the second chambers is less than the predetermined distance. The ink level control system includes an ink router associated with the inlet of the reservoir that directs ink received therethrough to one of the first and the second chambers when the reservoir is tilted in a first direction, and that directs ink to the other of the first and the second chambers when the reservoir is tilted in a second direction.

In another embodiment, an ink level control system for use in the on-board reservoir of a printhead comprises a plurality of walls for dividing the on-board reservoir into a plurality of chambers. Each wall extends a predetermined distance from a bottom surface of the reservoir to prevent ink from passing over the walls when an ink height in the chambers is less than the predetermined distance. An ink passage connects a first chamber located at one lateral end of the reservoir to a second chamber located at an opposite lateral end of the reservoir. A pumping system is associated with the ink passage that is configured to pump ink in the ink passage from the first chamber to the second chamber when the reservoir is tilted in a first direction, and from the second chamber to the first chamber when the reservoir is tilted in a second direction.

In yet another embodiment, a printhead includes an inkjet stack having ink passages that define a plurality of inkjets and an aperture plate that defines a plurality of apertures through which drops of ink are ejected by the inkjets. The printhead also includes a reservoir that is divided into a first chamber located at a first lateral end of the reservoir, a second chamber located at a second lateral end of the reservoir, and a center chamber located between the first and the second chamber. Each of the first and the second chambers is connected to the ink passages of the inkjet stack by an ink port. The reservoir includes an inlet that is configured to direct ink from a remote ink source into the center chamber. The first chamber is connected to the center chamber by a first valve, and the second chamber is connected to the center chamber by a second valve. The first valve and the second valve each have an open position that permits ink to pass between the center chamber and the first and the second chambers, respectively, and a closed position that prevents ink from passing between the center chamber and the first and the second chambers, respectively. A first buoyant member is located in the first chamber, and a second buoyant member is located in the second chamber. The first and the second buoyant members are configured to float in ink in the respective first and second chambers. The first buoyant member is coupled to the first valve to move the first valve from its closed position to its open position when the first buoyant member is dropped below a predetermined level by ink in the first chamber and to move the first valve from its open position to its closed position when the first buoyant member is lifted above the predetermined level by ink in the first chamber. The second buoyant member is coupled to the second valve to move the second valve from its closed position to its open position when the second buoyant member is dropped below the predetermined level by ink in the second chamber and to move the second valve from its open position to its closed position when the second buoyant member is lifted above the predetermined level by ink in the second chamber.

DETAILED DESCRIPTION

Figure 1:
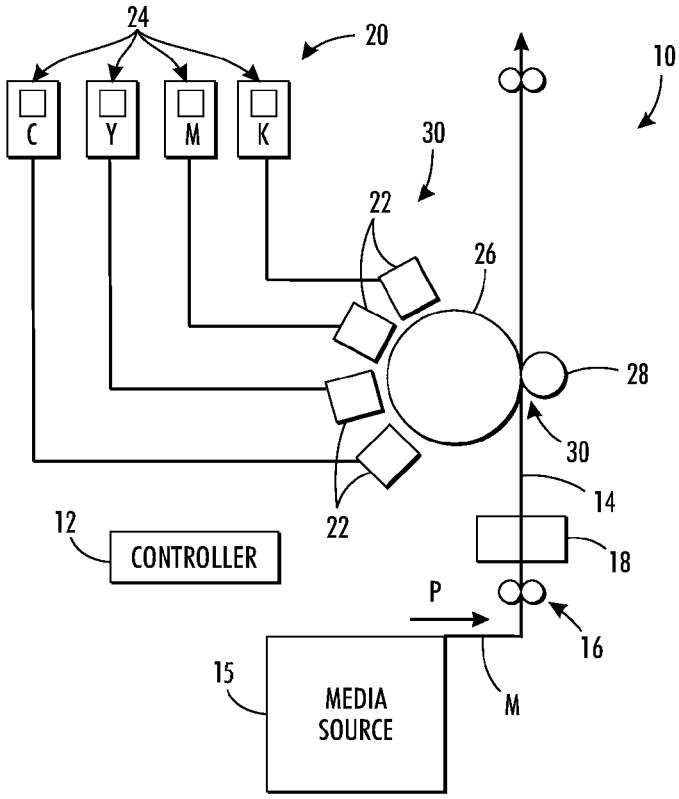
FIG. 1 is a simplified schematic view of an imaging device having an indirect printing system.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

As used herein, the process direction is the direction in which the substrate onto which ink is deposited moves through the imaging device. The cross-process direction, along the same plane as the substrate, is substantially perpendicular to the process direction. The term "y-axis" used in connection with an imaging device refers to axis or directions that are substantially parallel to the process-direction. The term "x-axis" refers to an axis or direction that is substantially perpendicular to the process-direction, i.e., substantially parallel to the cross-process direction. The term "width" used in reference to printheads refers to the dimension of the printhead that is to be arranged perpendicular to the process direction (y-axis), i.e., parallel to the cross-process direction (x-axis). The term "height" used in reference to the dimensions of a printhead refers to the dimension of the printhead that is to be arranged parallel to the process direction (y-axis). The term "tilt" or "tilted" refers to deviations of the orientation of a device from an intended, or normal, orientation.

Turning now to the drawings, FIG. 1 illustrates a simplified schematic diagram of an imaging device 10 configured to use wide printheads in which an ink level control system is incorporated. As depicted, the imaging device 10 includes a media transport system that is configured to transport print media 14 in a process direction P from a media source 15 along a media path M past various systems and devices of the imaging device 10, such as the printhead system 30. The media 14 may comprise any suitable type of media, such as paper, and may comprise individual sheets of print media, also referred to as cut sheet media, or a very long, i.e., substantially continuous, web of media, also referred to as a media web. When cut sheet media is used, the media source 15 may comprise one or more media trays as are known in the art for supplying various types and sizes of cut sheet media. When the print media 14 comprises a media web, the media source 15 may comprise a spool or roll of media. The media transport system includes suitable devices, such as rollers 16, as well as baffles, deflectors, and the like (not shown), for transporting the media 14 along media path M in the imaging device 10.

Various media conditioning devices and systems may be positioned along the media path M of the imaging device for controlling and regulating the temperature of the print media 14 as well as the ink deposited thereon. For example, in the embodiment of FIG. 1, a preheating system 18 may be provided along the media path for bringing the print media to an initial predetermined temperature prior to reaching the printhead system 30. The preheating system 18 can rely on contact, radiant, conductive, or convective heat to bring the media to a target preheat temperature, which in one practical embodiment, is in a range of about 30° C. to about 70° C.

As depicted in FIG. 1, the media transport system is configured to transport the print media 14 past a printhead system 30 that includes at least one wide printhead 22 configured to deposit ink onto an ink receiving surface to form images. One or more printheads may be provided for each color of ink used in the device 10. In the embodiment of FIG. 1, the imaging device 10 is configured to use four colors of ink, e.g., cyan, magenta, yellow, and black (CYMK), although more or fewer colors or shades, including colors other than CYMK, may be used. For simplicity, a single printhead is shown for each of the four primary colors—CYMK. Any suitable number of printheads for each color of ink, however, may be employed.

The imaging device 10 includes an ink supply system 20 that is configured to supply ink from at least one remote source 24 of ink to the printhead system 30. The imaging device 10 includes four (4) remote sources 24 of ink representing the four colors—CYMK. Any suitable number of remote ink sources may be used. In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. Accordingly, the ink supply system includes a phase change ink melting and control apparatus (not shown) for melting or phase changing the solid form of the phase change ink into a liquid form. The phase change ink melting temperature may be any temperature that is capable of melting solid phase change ink into liquid or molten form. In one embodiment, the phase change ink melting temperate is approximately 100° C. to 140° C. In alternative embodiments, however, the imaging device may be configured to use any suitable marking material or ink including, for example, aqueous ink, oil-based ink, UV curable ink, or the like.

In the embodiment of FIG. 1, the printhead system 30 is configured to use an indirect marking process in which the printheads 22 are arranged to deposit ink onto an intermediate imaging member 26 shown in the form of a drum, but which may also be in the form of a supported endless belt. A roller 28 is loaded against the surface of drum 26 to form a nip 34 through which the media 14 is fed in timed registration with the ink images deposited thereon by the printheads. Pressure, and in some cases heat, in the nip 34 causes the ink to be transferred from the drum 26 and be fixed to the media 14.

Figure 2:
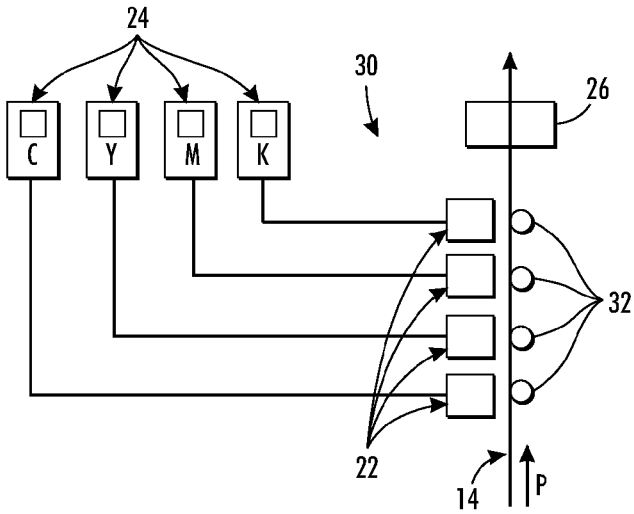
FIG. 2 depicts a direct printing system that may be utilized in the imaging device of FIG. 1 as an alternative to the indirect printing system.

In alternative embodiments, the printhead system 30 may be configured to utilize a direct marking process as shown in FIG. 2. In a direct marking process, the printheads of the printhead system 30 are arranged to deposit ink directly onto the media 14. The printed media is then guided to a fixing or spreading assembly 26 for fixing and/or spreading the ink to the media. In some embodiments, the fixing assembly includes a pair of rollers (not shown) that are loaded against each other to form a nip through which the media is fed. The nip is configured to apply pressure, and in some cases heat, to the ink in order to fix the ink to the media 14. The nip is also configured to spread out the drops of ink on the media so that spaces between adjacent drops are filled and image solids become uniform and achieve the desired level of gloss.

Operation and control of the various subsystems, components and functions of the imaging device 10 are performed with the aid of a controller 12. The controller 12 may be a self-contained, dedicated computer system having a central processor unit (CPU), electronic storage or memory, and a display or user interface (UI) (not shown). The controller 12 receives and manages image data flow between image input sources (not shown), which may be a scanning system or a work station connection, and the printheads 22. The controller 12 generates control signals that are delivered to the components and subsystems. These control signals, for example, include drive signals for actuating the inkjets of the printheads 22 to eject drops in timed registration with each other and with the movement of the print media 14 to form images on the media.

Figure 3:
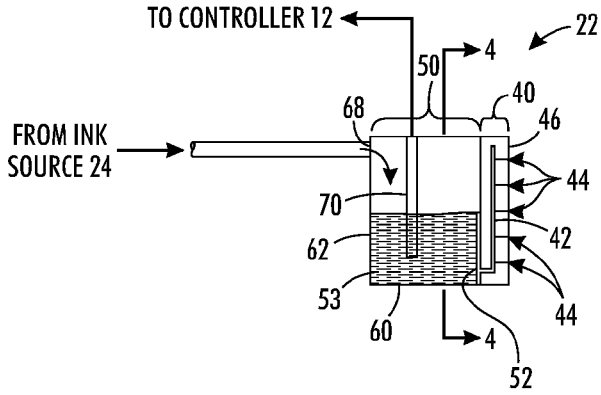
FIG. 3 is a side cross-sectional view of a printhead for use with the printing systems of FIGS. 1 and 2.
Figure 4:
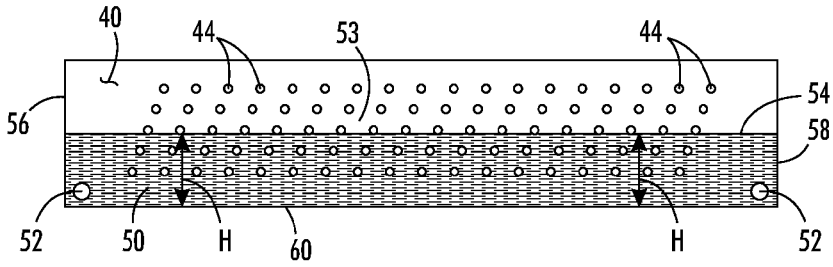
FIG. 4 is a front view of the printhead of FIG. 3.
Figure 5:
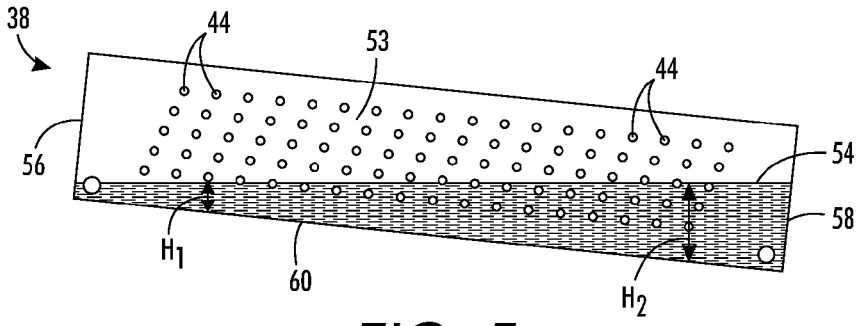
FIG. 5 is a front view of the printhead of FIG. 3 exhibiting tilt.

Referring now to FIGS. 3 and 4, an embodiment of a full width printhead 22 of the printhead system 30 is shown in more detail. As depicted, the printhead 22 includes an inkjet stack 40 having an aperture plate 46 in which apertures 44 of the inkjets are formed. The inkjets are supplied with ink by ink passages 42 in the inkjet stack 40. The ink passages 42 in turn receive ink from an on-board reservoir 50 of the printhead. As depicted, a plurality of outer walls, i.e., a bottom wall 60, rear wall 62, and lateral end walls 56, 58, cooperate to form a reservoir 53 that receives and retains ink, such as melted phase change ink. In one embodiment, the reservoir 53 is bound on the side opposite from the rear wall 62 by the rear of the inkjet stack 40. Alternatively, the reservoir may include an outer wall arranged adjacent to the rear of the jet stack 40 for enclosing the reservoir 53. The reservoir 53 and the ink passages 42 of the inkjet stack 40 are connected by one or more ink ports 52. As used herein, the term "port" refers to an opening or passage that enables a fluid, such as ink, to pass from one area to another. As depicted in FIG. 4, two ink ports 52 may be used to connect the reservoir 53 to the ink passages (not shown in FIG. 4) of the inkjet stack 40, although any suitable number of ports may be used.

The reservoir 53 receives ink from a remote source 24 of ink via one or more inlet openings 68. The reservoir 53 is provided with at least one level sensor 70 that is configured to generate signals indicative of the amount of ink in the reservoir 53. Any suitable type of level sensor 70 may be used. In one embodiment, the level sensor 70 is configured to generate at least an ink low signal when the ink level or ink height in the reservoir is at a predetermined low level. The ink low signal initiates an ink supply operation in which ink is delivered to the on-board reservoir from the remote ink source. The level sensor may also be configured to generate an ink full signal to indicate when the ink height in the reservoir has reached a predetermined high level which indicates that ink supply operations to the reservoir should cease.

As discussed above, wider printheads may be more susceptible to difficulties associated with printer or printhead tilt than narrower printheads. In order to reduce or prevent the difficulties associated with tilting, the on-board reservoir of a printhead may be provided with an ink level control system according to the embodiments described herein that divides the reservoir of the printhead into a plurality of chambers and controls the ink level in each chamber separately in order to maintain a top surface of ink in each chamber within a predetermined distance from the bottom surface of the reservoir.

Figure 6A:
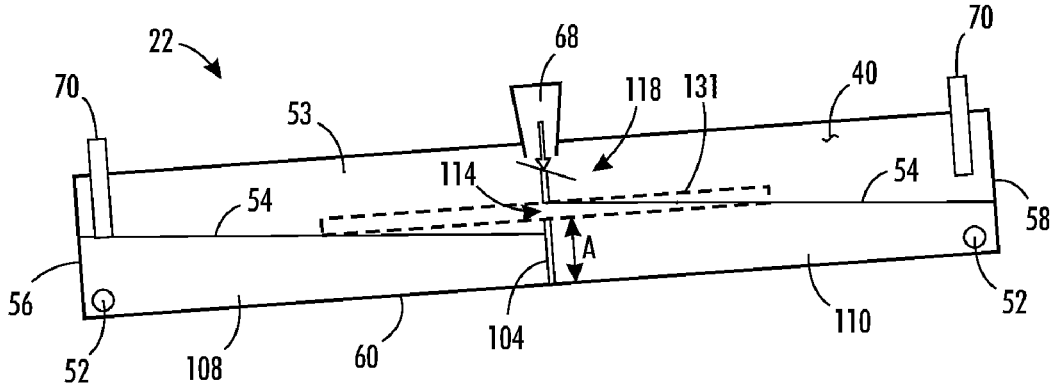
FIG. 6A depicts a printhead having an on-board reservoir with one embodiment of an ink level control system incorporated therein.

In FIG. 6A, a printhead 22 is shown having an on-board reservoir 53 in which one embodiment of an ink level control system is incorporated. As depicted, the ink level control system includes an inner dividing wall 104 that extends from the bottom surface 60 of the reservoir 53 that divides the reservoir 53 into a first chamber 108 and a second chamber 110. The first 108 and second chambers 110 are each adjacent the inkjet stack 40 and connected to the ink passages (42 in FIG. 3) of the inkjet stack by an ink port 52. An ink level sensor 70 is provided in each of the chambers 108, 110 for detecting the ink height, or ink level, 54 in each chamber. The ink level sensors 70 output signals indicative of the ink level to a controller, such as imaging device controller 12. The reservoir includes an inlet opening 68 through which ink is delivered to the reservoir from a remote ink source (not shown in FIG. 6). Ink is delivered to the reservoir 50 through the inlet opening 68 when one or both of the ink level sensors 70 indicate that the ink level 54 in one of the chambers is at or below the low ink level.

The dividing wall 104 includes an opening 114 that is spaced from the bottom surface 60 of the reservoir by a distance A. The opening 114 thus enables ink to pass between the chambers 108, 110 when the distance between the top surface of the ink and the bottom surface of the reservoir is the same as or greater than the distance A. Similarly, when the distance between the top surface 54 of the ink in the chambers 108, 110 and the bottom surface 60 of the reservoir is less than the distance A, the ink in a chamber is prevented from escaping and thus not allowed to pass between the first chamber and the second chamber. In one embodiment, the distance A is selected based on a maximum height or ink level that is desired to be maintained in each chamber.

Figure 6B:
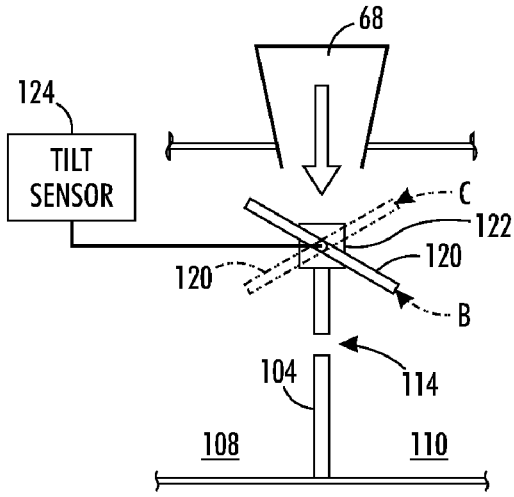
FIG. 6B depicts the ink diverter of FIG. 6A in more detail.

As depicted in FIG. 6A, an ink diverting or routing device 118 is associated with the inlet opening 68, also referred to herein as an ink diverter. The ink diverter may be any suitable device or mechanism that is capable of controlling the flow of ink into the reservoir so that the ink is directed to either the first chamber or the second chamber. In one embodiment as depicted in FIG. 6B, the ink diverter includes an ink directing or deflecting surface 120, such as a valve plate, that is movable between at least a first position B (depicted with a solid line in FIG. 6A) in which the diverter directs the flow of ink from the inlet into the chamber 110, and a second position C (depicted with a dotted line in FIG. 6B) in which the diverter 118 directs ink into the chamber 108.

A suitable actuating device 122, such as a solenoid, is coupled to the ink diverter 120 to move the diverter between the first position B and the second position C. The actuating device 122 in turn is controlled by a tilt sensitive device 124, such as a tilt sensor or tilt gauge, as they are known in the art. The tilt sensor 124 is configured to detect the direction of tilt of the reservoir. For example, the tilt sensor 124 may be configured to generate a first signal to indicate that the reservoir is tilted in a first direction and a second signal to indicate that the reservoir is tilted in a second direction. As an example, the printhead of FIG. 6A is shown tilted in a first direction so that the left lateral end 56 is lower than the right lateral end. A second direction of tilt corresponds to when the printhead is tilted so that the right lateral end 58 of the reservoir is lower than the left lateral end 56. The actuating device 122 is configured to move the diverter 120 to the first position B when the tilt sensor 124 generates the first signal and to move the diverter 120 to the second position C when the tilt sensor generates the second signal. In alternative embodiments, the ink diverter may be passively controlled such as by using a pendulum or float system that changes position based on the tilt of the printhead.

When the reservoir is not tilted, the ink diverter 118 may direct or divert ink that is received at the inlet to one or both of the first and second chambers 108, 110. The opening 114 in the wall enables ink from one chamber to fill the other chamber when the ink level reaches the height of the opening 114. When the reservoir is tilted, the actuating device 122 is configured to control the position of the diverter 120 in accordance with the direction of tilt indicated by the tilt sensor 124 so that ink is directed to the chamber at the higher end of the reservoir, e.g., chamber 110 in FIG. 6A. The wall 104 prevents ink from escaping the higher chamber until the ink level 54 in the higher chamber is at the opening 114. Thus, the ink level in the higher end of the tilted reservoir is prevented from falling too low and dropping below the level of the ink port 52. In addition, ink reaches the lower chamber, e.g., chamber 108, only after the higher chamber has been filled with ink to the point that it is allowed to pass through the opening 114 and into the lower chamber. The ink level in the lower end 108 of the reservoir is therefore prevented from increasing to the level that would result in the absence of the ink level control system.

In some embodiments, the hole or opening 114 that connects the first chamber 108 and the second chamber 110 may be provided with a tube or conduit 131 (shown as a dashed line in FIG. 6A). As depicted, one end of the tube is located near the center of the first chamber 108 and the other end of the tube is located in the center of the second chamber 110. The tube 131 is configured to enable ink to pass through the tube only when the ink level rises to the height of the opening in the center of the chamber. The ink level in the center chamber is less affected by tilt and therefore more closely corresponds to the ink level when the reservoir is not tilted. Therefore, the tube 131 may enable ink levels in the tilted reservoir to more closely approximate the corresponding ink levels when the reservoir is not tilted. In addition, although the diverter 120 has been described as having an active control system for controlling ink flow into the reservoir, any suitable type of control system, including passive control systems or a combination of active and passive control elements, may be used to enable the diverter 118 to divert ink to the higher chamber in response to tilting of the reservoir. In embodiments, the tube 131 may extend any suitable distance in a chamber, and the distance that the tube 131 extends in the chambers may be the same or different.

Figure 7A:
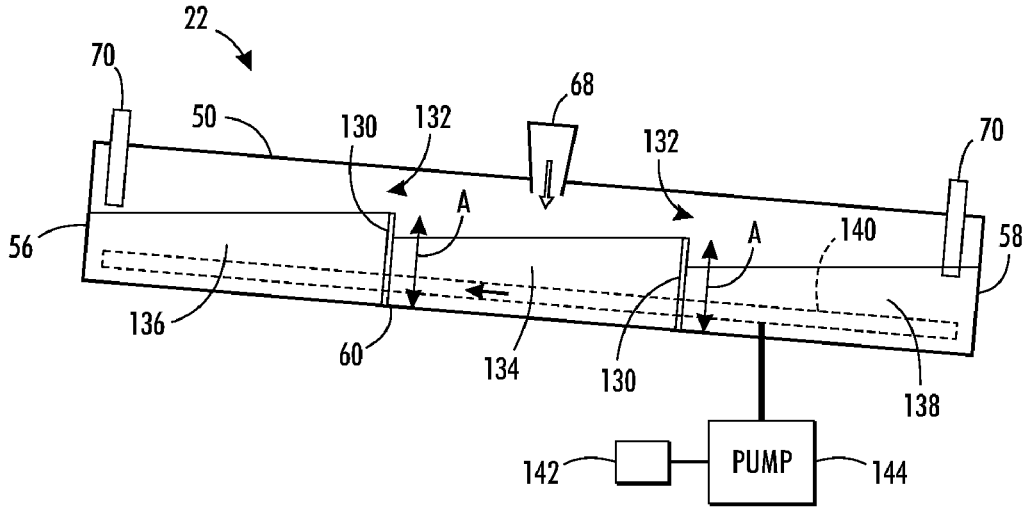
FIGS. 7A and 7B depict a printhead having an on-board reservoir with another embodiment of an ink level control system incorporated therein and tilted in a first direction (FIG. 7A) and a second direction (FIG. 7B).
Figure 7B:
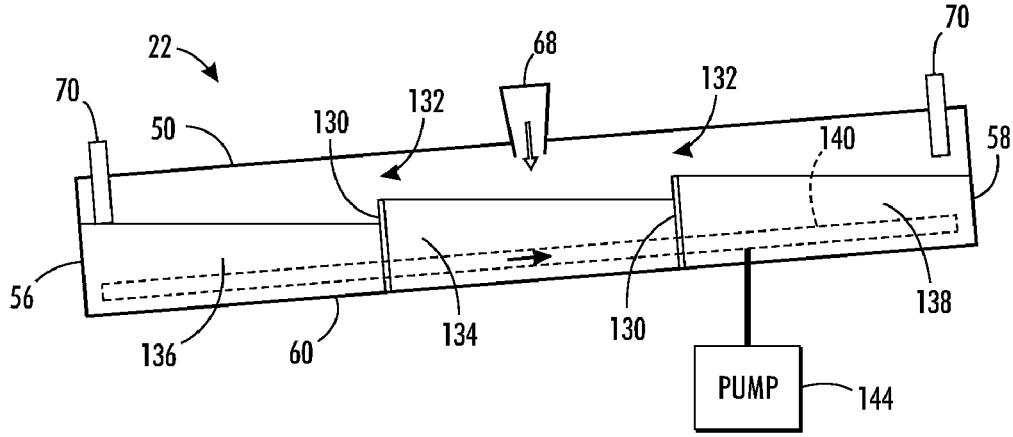

Referring now to FIGS. 7A and 7B, a printhead 22 is depicted having an on-board reservoir 50 with another embodiment of an ink level control system. The embodiment of the ink level control system of FIGS. 7A and 7B utilizes a system of dams, or weirs, 130 positioned in the on-board reservoir 50 to divide the reservoir 50 into a plurality of chambers or sections. The dams, or weirs, 130 comprise walls that extend from the bottom 60 of the reservoir to define open sections or openings 132 a distance A from the bottom surface 60. Thus, ink is prevented from passing over the weirs 130 when the ink level in a chamber is less than the distance A from the bottom surface of the reservoir. When the ink level is greater than the distance A from the bottom surface, ink may pass over the weir into the adjacent chamber. In the embodiment of FIGS. 7A and 7B, two weirs 130 are provided for dividing the on-board reservoir into three sections, i.e., a center section 134, and two side sections 136, 138 although in alternative embodiments more than two weirs 130 may be used. In the embodiment of FIGS. 7A and 7B, the inlet 68 of the reservoir is configured to direct ink into only the center chamber 134. Although not depicted in FIGS. 7A and 7B, each of the side chambers is connected to the inkjet stack via an ink port, such as shown in FIG. 6. An ink level sensor 70 is located in each of the side chambers 136, 138. When an ink level sensor detects that the ink level in a side chamber 136, 138 is low, ink is supplied to the center chamber 134.

As seen in FIGS. 7A and 7B, when the printhead 22 is tilted, the weir 130 on one of the sides of the center chamber 134 is lower than the other. Accordingly, during operations, when ink is supplied to the center chamber 134, the ink fills the center chamber 134 until the ink level 54 reaches the height of the lower weir 130 at which point the ink is allowed to pass over the weir and drop into the corresponding lower side chamber, e.g., chamber 138 in FIG. 7A and chamber 136 in FIG. 7B. A tube or conduit 140 is provided that extends between the side chambers 136, 138 to enable ink to be distributed from the chamber in the lower end of the reservoir to the side chamber (s) in the higher end of the reservoir. In the embodiment of FIGS. 7A and 7B, the conduit 140 is positioned near the bottom wall 60 of the reservoir and includes a first open end located in the side chamber 138 and a second open end located in the side chamber 136.

A pump 144 is provided for pumping ink from the lower side chamber to the higher side chamber via the conduit 140. Any suitable type of pump or pumping system may be used. For example, in one embodiment, a reversible displacement pump, such as a gear pump or peristaltic pump, is positioned within the tube to pump ink in both directions in the tube. In one embodiment, the direction of pumping may be controlled based on input from a tilt sensor or tilt gauge 142. The pump 144, however, may be controlled in any suitable manner so that ink is pumped from the lower chamber of the tilted reservoir to the higher chamber of the tilted reservoir. In operation, ink fills the center chamber 134 and then passes over the lower weir 130 and falls into the lower side chamber, e.g., chamber 138 in FIG. 7A and chamber 136 in FIG. 7B. The ink in the lower side chamber is pumped to the higher side chamber via the conduit 140. If the ink level in the higher side chamber rises above the weir 130, the ink falls back into the center chamber 134 and the cycle continues. Thus, ink is circulated through the chambers of the reservoir to maintain the ink level in each section within a predetermined range so that the ink level 54 is approximately the same in each chamber.

Ink circulation through the chambers of the reservoir as described above enables alternative ink inlet configurations. For example, instead of supplying ink via an ink inlet to the center chamber, ink inlets may be provided in each of the end chambers that are controlled by a suitable diverter or valve system so that ink is only delivered to the chamber at the high end of a tilted reservoir. The ink would then be able to flow from the chamber at the high end to the low end of the reservoir. Ink could then be pumped selectively from the lower end to the upper end, depending on the direction of tilt, so that ink would continue to cascade to the wall or port level between chambers. This concept is applicable to any multi-chamber reservoir configuration.

Figure 8A:
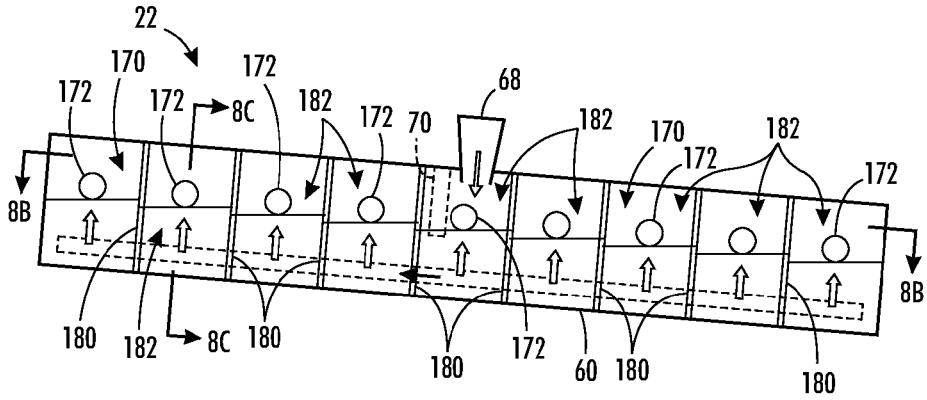
FIGS. 8A-8C depict an alternative to the embodiment of the ink level control system of FIGS. 7A and 7B.
Figure 8B:
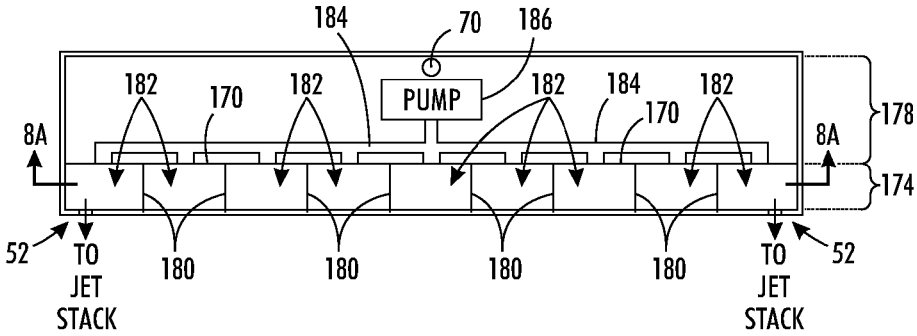
Figure 8C:
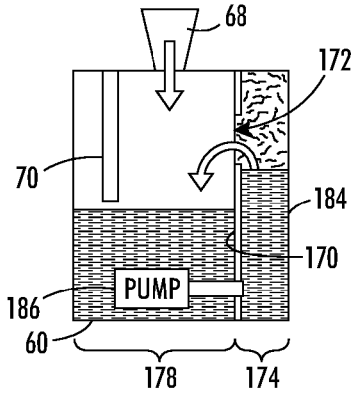

FIGS. 8A-8C depict an alternative to the configuration of the ink level control system of FIGS. 7A and 7B. In FIGS. 8A-8C, the reservoir 50 includes a first dividing wall 170 that divides the reservoir 50 longitudinally into a primary reservoir 174 located closer to the jet stack (not shown) and a secondary reservoir 178 (FIGS. 8B and 8C) located behind the primary reservoir 174 relative to the jet stack. In addition, a plurality of dividing walls 180 are provided in the primary reservoir 174 that divide the primary reservoir 174 into a plurality of chambers 182. Ink ports 52 are provided in one or more of the chambers 182 for supplying the jet stack with ink from the chambers 182. In one embodiment, ink ports 52 are provided in the chambers 182 located at the ends of the reservoir although ports may be provided in any or all of the ports, including intermediate chambers. The dividing walls 180 in the primary reservoir 174 extend most or all of the way from the bottom surface to the top of the reservoir to prevent ink from passing to adjacent chambers 182 in the primary reservoir 174. In this embodiment, the first dividing wall 170 comprises a weir that defines openings 172 that are each located a distance A above the bottom surface 60 of the reservoir and that enable ink to pass from a chamber 182 to the secondary reservoir 178 when the ink height in the chamber 182 is greater than the distance A above the bottom surface 60.

In the embodiment of FIGS. 8A-8C, the ink inlet 68 is configured to direct ink into the secondary reservoir 178. At least one level sensor 70 is located in the secondary reservoir 178 for controlling the amount of ink that is delivered to and/or maintained in the secondary reservoir 178. Ink is delivered to each of the chambers 182 in the primary reservoir 174 from the secondary reservoir 178 using a suitable delivery system. As an example, a manifold and pump system may be used that includes a plurality of conduits or tubes 184 that connect each chamber to the secondary reservoir and a pump 186 for pumping ink through the conduits 184 to each of the chambers 182. Any suitable type of pump or pumping system may be used. During operation, as ink is pumped into each chamber 182, the ink fills each chamber and flows through the openings 172 and into the secondary reservoir 178 as depicted in FIG. 8C. Thus, while ink is being pumped to the chambers 182, the ink height in each chamber 182 is maintained at substantially the same height which corresponds to the distance A of the openings 172 in the first dividing wall 170 from the bottom surface 60 of the reservoir 50.

Figure 9A:
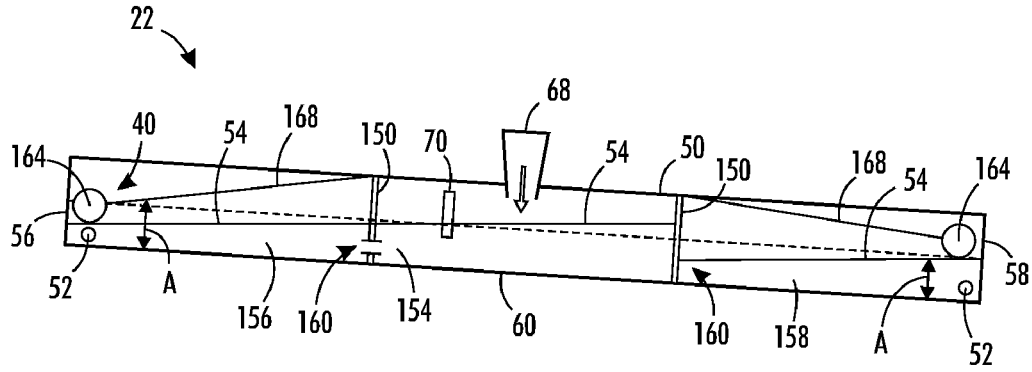
FIGS. 9A and 9B depict a printhead having an on-board reservoir with yet another embodiment of an ink level control system incorporated therein and tilted in a first direction (FIG. 9A) and a second direction (FIG. 9B).
Figure 9B:
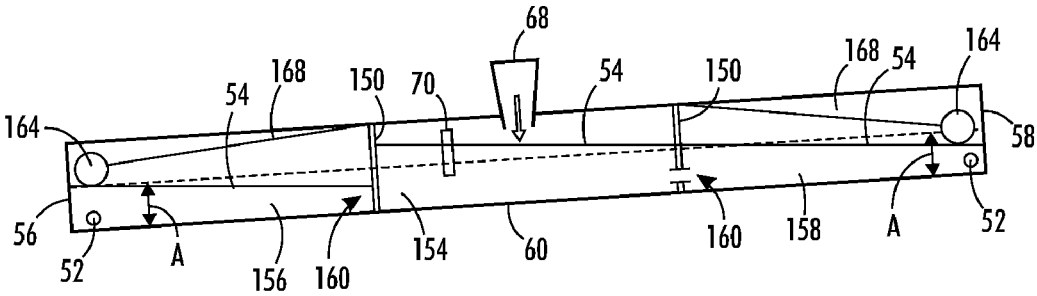

Referring now to FIGS. 9A and 9B, another embodiment of an ink level control system is depicted. In the embodiment of FIGS. 9A and 9B, the ink level control system includes walls 150 that divide the reservoir into a center chamber 154, and a pair of side chambers 156, 158 similar to the embodiment of FIGS. 7A and 7B. In the embodiment of FIGS. 9A and 9B, however, the walls 150 extend substantially all the way to the top of the reservoir. Each of the side chambers is connected to the inkjet stack 40 by an ink port 52. Ink is supplied to only the center chamber 154 via the inlet 68, and an ink level sensor 70 is located in the center chamber for controlling ink supply operations to the center chamber. In this embodiment, the ink level in the side chambers is controlled by a mechanical float and valve system that is configured to distribute ink from the center chamber 154 to the side chambers 156, 158.

In one embodiment, the mechanical float and valve system comprises a flow control structure 160, such as a valve, located in each wall 150. Any suitable type of flow control structure of valve may be used. In one embodiment, the flow control structures 160 comprise a valve having an open position that enables ink to pass between the center chamber and the first and the second chambers, respectively, and a closed position that prevents ink from passing between the center chamber and the first and the second chambers, respectively. A buoyant member or device 164, referred to herein as a float, is provided in each of the side chambers 156, 158. The float 164 is configured to float at or near the top surface 54 of the ink in each of the side chambers 156, 158.

The float 164 in each chamber 156, 158 is coupled to the corresponding valve 160 for that chamber in a manner that enables the float 164 to move the valve 160 between its open and closed positions as the float is lowered and raised in the chambers by the ink level 54. In the embodiment of FIGS. 9A and 9B, each float 164 is connected to the corresponding valve 160 by a lever 168. The lever 168 is attached to the associated valve 160 so that, when the lever 168 is moved toward the top of the reservoir by the float 164, the lever 168 moves the valve toward its closed position and when the lever is moved toward the bottom 60 of the reservoir, the valve is moved toward its open position. The valves 160 are configured to be in the closed position when the corresponding float 164 is a predetermined distance A or greater above the bottom surface 60 of the reservoir by the ink level 54, and to be in the open position when the float 164 is less than the distance A above the bottom surface 60. Thus, as the float 164 is moved up and down in the ink chamber by changing ink levels, the float 164 moves the lever 168 to open and close the valves 160 and control the flow of ink into the side chambers 156, 158 from the center chamber 154.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A printhead for use in an imaging device, the printhead comprising:

an jet stack including ink passages that define a plurality of inkjets and an aperture plate that defines a plurality of apertures through which drops of ink are ejected by the inkjets;

a reservoir associated with the jet stack and configured to contain a quantity of ink, the reservoir including an inlet opening through which ink is received in the reservoir; and an ink level control system including:

a first dividing wall that divides the reservoir into a first chamber and a second chamber, the first and the second chambers each being connected to the ink passages of the inkjet stack by an ink port, the first dividing wall including an opening that connects the first chamber and the second chamber to enable ink to pass therebetween, the opening being located a predetermined distance above the bottom surface of the reservoir; and an ink diverter associated with the inlet opening that directs ink received through the inlet opening to one of the first and the second chambers in response to the reservoir being tilted in a first direction, and directs ink to the other of the first and the second chambers in response to the reservoir being tilted in a second direction.

2. The printhead of claim 1, the ink diverter further comprising:

an ink diverting surface configured to move between a first position in which it diverts ink to the first chamber and a second position in which it diverts ink to the second chamber.

3. The printhead of claim 2, further comprising an actuator for moving the ink diverting surface between the first and the second positions.

4. The printhead of claim 3, further comprising:

a tilt sensor configured to generate a first signal indicative of the printhead being tiled in the first direction and a second signal indicative of the printhead being tiled in the second direction, the actuator being configured to move the ink diverting surface between the first and the second positions based on the signals generated by the tilt sensor.

5. The printhead of claim 2, wherein the ink diverting surface is configured to be moved to the first and the second positions using a passive control system.

6. The printhead of claim 1, further comprising:

a tube associated with the opening in the first dividing wall having a first open end positioned in a center of the first chamber and a second open end positioned in a center of the second chamber, the first and second open ends of the tube being located above the bottom surface of the reservoir by the predetermined distance.

7. The printhead of claim 1, the jet stack being configured to utilize molten phase change ink.

8. An on-board reservoir for use with a printhead of an imaging device, the reservoir comprising:

a reservoir for containing a quantity of ink, the reservoir including an inlet opening through which ink is received in the reservoir;

a plurality of inner walls that divide the reservoir into a plurality of chambers, each inner wall extending a predetermined distance from a bottom surface of the reservoir;

an ink conduit that connects a first chamber to a second chamber located near opposing ends of the reservoir; and a pump associated with the ink conduit for pumping ink through the conduit from the first chamber to the second chamber in response to the reservoir being tilted in a first direction, and to pump ink from the second chamber to the first chamber in response to the reservoir being tilted in a second direction.

9. The reservoir of claim 8, the plurality of chambers including a first side chamber positioned at one side of the center chamber, and a second side chamber positioned adjacent the center chamber opposite the first side chamber;

wherein the inlet opening is positioned to direct ink into the center chamber; and wherein a first ink level sensor is located in the first side chamber and a second ink level sensor is located in the second side chamber.

10. The reservoir of claim 9, wherein ink is delivered to the center chamber through the inlet opening in response to either the first or the second level sensor indicating that an ink level in the corresponding first and second side chambers is low.

11. The reservoir of claim 8, wherein the plurality of inner walls comprise a plurality of weirs that enable ink to pass from chamber to chamber when an ink height in a chamber is greater than the predetermined distance.

12. The reservoir of claim 8, the pump comprising a rotary displacement pump associated with the ink conduit.

13. A printhead for use in an imaging device, the printhead comprising:

an inkjet stack including ink passages that define a plurality of inkjets and an aperture plate that defines a plurality of apertures through which drops of ink are ejected by the inkjets;

a reservoir configured to contain a quantity of ink, the reservoir including an inlet opening through which ink is received in the reservoir; and an ink level control system including:

a plurality of dividing walls that divide the reservoir into a first chamber, a second chamber, and a center chamber located between the first and the second chamber, first and the second chambers being connected to the ink passages of the inkjet stack by an ink port, the inlet opening of the reservoir being configured to direct ink to the center chamber; and a first valve that connects the first chamber and the center chamber, and a second valve that connects the second chamber and the center chamber, the first valve and the second valve each having an open position that enables ink to pass between the center chamber and the first and the second chambers, respectively, and a closed position that prevents ink from passing between the center chamber and the first and the second chambers, respectively;

a first buoyant member located in the first chamber, and a second buoyant member located in the second chamber, the first and the second buoyant members being configured to float in ink in the respective first and second chambers, the first buoyant member being coupled to the first valve to move the first valve from the closed position to the open position in response to the first buoyant member being dropped below a predetermined level by ink in the first chamber and to move the first valve from the open position to the closed position in response to the first buoyant member being lifted above the predetermined level by ink in the first chamber; and the second buoyant member being coupled to the second valve to move the second valve from the closed position to the open position in response to the second buoyant member being dropped below the predetermined level by ink in the second chamber and to move the second valve from the open position to the closed position in response to the second buoyant member being lifted above the predetermined level by ink in the second chamber.

14. The printhead of claim 13, further comprising an ink level sensor is located in the center chamber.

15. The printhead of claim 13, the jet stack being configured to utilize molten phase change ink.

16. The printhead of claim 13, the ink jets of the jet stack being configured to eject drops of ink onto an intermediate imaging member.

17. A printhead for use in an imaging device, the printhead comprising:

an inkjet stack;

a reservoir connected to the jet stack via at least one ink port, the reservoir including:

at least one inlet through which ink is supplied to the reservoir from a remote source of ink;

at least one wall that divides the reservoir into a plurality of chambers, each wall including at least one opening that connects adjacent chambers;

a conduit that extends from a chamber located at one end of the reservoir to a chamber located at an opposite end of the reservoir;

a pump configured to pump ink from the end chamber at a lower end of the reservoir to the end chamber at the higher end of the reservoir.

18. The printhead of claim 17, the at least one inlet comprising at least two inlets with a first inlet being positioned to direct ink into one of the end chambers and a second inlet being positioned to direct ink into the other of the end chambers.

19. The printhead of claim 18, the first and second inlets including valves such that ink is delivered to the end chamber at the higher end of the reservoir.

* * * * *